United States Patent [19]

Mathes et al.

[11] Patent Number: 4,563,951

[45] Date of Patent: Jan. 14, 1986

[54] CLAMPING AND ADJUSTING DEVICE FOR THE SMOOTHING MEANS ON THE STORAGE CYLINDER OF A SHEET OFFSET PRESS

[75] Inventors: Josef Mathes, Offenbach am Main; Roland Höll, Weiterstadt, both of Fed. Rep. of Germany

[73] Assignee: M.A.N.-Roland Druckmaschinen Aktiengesellschaft, Fed. Rep. of Germany

[21] Appl. No.: 715,476

[22] Filed: Mar. 25, 1985

[30] Foreign Application Priority Data

Mar. 23, 1984 [DE] Fed. Rep. of Germany ..... 3410689

[51] Int. Cl.[4] ..... B41F 5/00

[52] U.S. Cl. ..... 101/216; 101/230; 101/410

[58] Field of Search ..... 101/415.1, 216, 230, 101/220, 224, 229, 232, 246, 248, 410

[56] References Cited

U.S. PATENT DOCUMENTS

| | | | |
|---|---|---|---|
| 3,205,814 | 9/1965 | Huck | 101/216 |
| 3,229,629 | 1/1966 | Conchon et al. | 101/216 X |
| 3,276,362 | 10/1966 | Grunig | 101/216 |
| 4,290,353 | 9/1981 | Pav et al. | 101/216 |
| 4,487,122 | 12/1984 | George et al. | 101/216 |
| 4,530,283 | 7/1985 | Mathes et al. | 101/230 |

*Primary Examiner*—E. H. Eickholt

*Attorney, Agent, or Firm*—Leydig, Voit & Mayer, Ltd.

[57] ABSTRACT

Apparatus is provided for simple and reliable adjusting of the smoothing means on a storage cylinder of a sheet of set press to adjust the smoothing means relative to the sheet end when the press is selectively changed from first printing to perfecting printing operation. The storage cylinder is mounted on a hollow main shaft in which a hollow intermediate shaft and an adjusting shaft are concentrically mounted. Clamping cams are disposed on the intermediate shaft and act by way of cam followers and expanding finger sleeves to clamp or release the elements which carry the smoothing means on the main shaft. The position of the smoothing means relative to the main shaft is adjusted by way of epicyclic gearing interposed between one end of the adjusting shaft and the hollow main shaft. The relationship of the intermediate shaft and the adjusting shaft are selectively changed and locked in operative position by axially aligned internal non-circular control elements interconnected by a non-circular drive key which is axially slidable out of engagement with the non-circular control elements by insertion of a correspondingly shaped adjusting key.

7 Claims, 4 Drawing Figures

CLAMPING AND ADJUSTING DEVICE FOR THE SMOOTHING MEANS ON THE STORAGE CYLINDER OF A SHEET OFFSET PRESS

FIELD OF THE INVENTION

The present invention relates generally to a clamping and adjusting device for the smoothing means on a storage cylinder of a sheet offset press adapted for selective first printing or perfecting printing operation and more particularly concerns means for adjusting and clamping the smoothing means relative to the outer shell of the storage cylinder by centrally disposed actuator mounted within the main shaft on which the shell and the smoothing means are carried.

BACKGROUND OF THE INVENTION

Sheet-fed rotary presses with provision for sheet turning need various adjustable sheet-guiding elements. In the customary method of turning sheets by way of their rear edge, the sheet must be accurately guided, retained and smoothed on a cylinder which precedes the actual turning cylinder and which is referred to as a storage cylinder. Conventionally, suction or gripper means are used for this purpose. Such means must be positioned relative to the storage cylinder grippers in a manner adapted to the format of the particular sheets used. When a press of this kind is changed over from first printing to perfecting printing, the suction or gripper means must be adjusted to the rear edge of the sheet relative to the storage cylinder grippers and in accordance with the particular sheet format used. This adjustment is normally made independently of the adjustment of the grippers from first printing to perfecting. However, it is important for this adjustment to be one which can be carried out simply and accurately, otherwise sheet conveyance may not be accurate enough in perfecting printing.

A device of this kind has been described, for instance, in German Patent Specification No. 3,128,947. As shown here, radial clamping means are disposed in the hollow shaft in the sheet transfer cylinder for a press and comprise an inner tube, which extends over the whole length of the shaft, and a second outer tube movingly mounted on the inner tube. The two tubes have conical surfaces which are directed towards one another and which are applied to ball cages disposed in the shaft of the sheet transfer cylinder. By clamping the two tubes together the ball cages can be pressed apart from one another in the shaft of the sheet transfer cylinder and the suction means pivotally mounted on the shaft can be clamped fast therewith, for instance, by a nut screwed on to the inner tube and bearing on the outer tube. An adjusting shaft having a gearwheel is mounted in the inner tube. By rotating the gearwheel the suction means can be pivoted on the shaft of the sheet transfer cylinder.

However, a serious disadvantage of the foregoing system is that it is a very complicated construction. For instance, the inner tube has to have bevellings, a step or shoulder for the mounting in the shaft and requires an aperture for the adjusting gearwheel. Moreover, the inner tube extends over the entire length of the shaft and control is difficult because the control elements for clamping are different from the control elements needed to adjust the suction means. Considerable forces are also needed to clamp the suction means and it is not always clear when the clamping force is sufficient and, therefore, reliable. In other words, the position of the conical surfaces in which the suction means have been clamped is uncertain and the control distance can therefore vary considerably. Finally, the assembly of the complete system is complicated and involves a very substantial expense.

OBJECTS AND SUMMARY OF THE INVENTION

It is therefore the primary aim of the present invention to provide substantial simplification in a device of the kind described with respect to its assembly, arrangement and operation so that only one accessory tool is needed for clamping and adjustment changes and wherein the operating states of release and clamping are clear although the controlled distance is considerably reduced.

To this end, according to the present invention, a clamping and adjusting device for the smoothing means on a storage cylinder of a sheet offset press adapted for selective first printing or perfecting printing operation is provided wherein the smoothing means are mounted by way of carrying elements on a hollow main shaft of the storage cylinder and are adapted to be released, adjusted and, by way of clamping elements, clamped relative to the outer shell of the storage cylinder by central actuators. More particularly, a unitary hollow drive shaft is rotatably mounted within the hollow main shaft of the storage cylinder and has a first control element at one end and clamping cams on its periphery adjacent its other end, the clamping elements including cam followers in bearing relationship between the clamping cams and the carrying elements; and an adjusting shaft is rotatably mounted in the unitary hollow drive shaft and carries a second control element at its one end and has at its other end a gearwheel forming part of epicyclic gearing adapted to pivot the smoothing means on the storage cylinder.

It is another feature of the present invention that it is much more compact than the prior art. Only a short control travel is necessary to clamp or release the smoothing means on the shaft. The same accessory, for example, an internal hexagon key or spanner, is used to clamp and adjust the smoothing means. The complete unit can be pre-assembled outside the storage cylinder shaft and introduced complete. Clamping of the suction means on the storage cylinder shaft is more reliable because spring sets even out the forces on the various clamping elements and permit a catch on the clamping cams.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
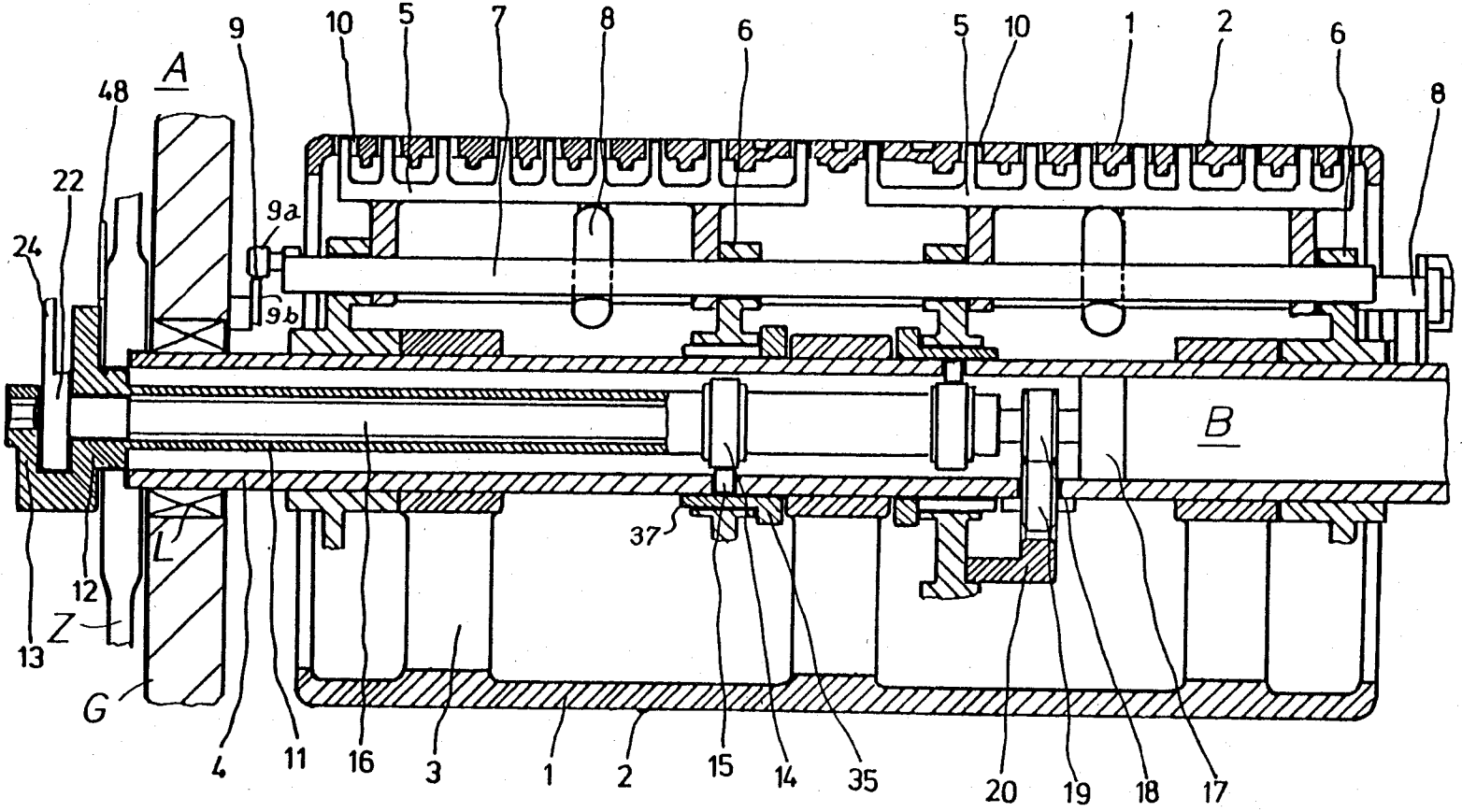
FIG. 1 is a longitudinal section taken through a storage cylinder for a printing press having adjustable smoothing means in accordance with the present invention.

Turning now to the drawings, there is shown in FIG. 1, a storage cylinder for a sheet-fed offset printing press having adjustable smoothing means of the present invention. For the sake of clarity of this disclosure, the conventional grippers of the cylinder are not shown. The storage cylinder includes an outer shell 1 which forms a sheet-guiding surface 2 and is connected by way of a number of support elements 3 to a hollow main shaft 4. Smoothing means 5 are pivotally mounted on the main shaft 4 by way of carrying elements 6 which are pivotable relative thereto. The two middle carrying elements 6 are secured on the shaft 4 by way of intermediate elements to be described in more detail hereinafter.

A pivot shaft 7 to which the smoothing means 5 are rigidly connected is mounted on the carrying elements 6 and a vacuum feed 8 for the smoothing means 5 is disposed adjacent the shaft 7. A drive 9 is connected to end A of shaft 7 and serves to move the smoothing means 5 peripherally with respect to the storage cylinder 1. The drive 9 comprises a cam 9*a* rigidly secured to the frame G and a cam follower 9*b* connected to the shaft 7. The smoothing means 5 extend through slots 10 in the outer shell 1.

Adjusting means for clamping and adjusting the smoothing means 5 are mounted within the main shaft 4. The construction and association of the adjusting means will be described in detail hereinafter with reference to FIG. 2. A second hollow shaft 11 is rotatably mounted at end A and is journalled by a bearing element 12 in a driving gear Z rigidly connected to the main shaft 4. The bearing element 12 has a prolongated end 13 which serves to house a control element 21 (See FIG. 2).

Adjacent its other end, two clamping cams 14 are pinned to the hollow shaft 11 and cooperate with clamping elements 15 whose construction will be described in greater detail hereinafter with reference to FIG. 4. Three clamping elements 15 are associated with each cam 14. Because of the double three-point support the hollow drive shaft 11 is self-aligning. An adjusting shaft 16 disposed in the hollow drive shaft 11 has a control element 23 at end A and is rotatably mounted in shaft 11. Disposed at end B is a bearing unit 17 in which the adjusting shaft 16 is rotatably mounted within the main shaft 4. A sun gearwheel 18 is disposed on the same end of the shaft 16 and meshes with an intermediate planetary gearwheel 19 which meshes with a toothed annulus segment 20 secured to the right hand carrying element 6. The planetary gearwheel 19 is rotatably mounted in the wall of the main shaft 4 (See FIG. 3).

Figure 2:
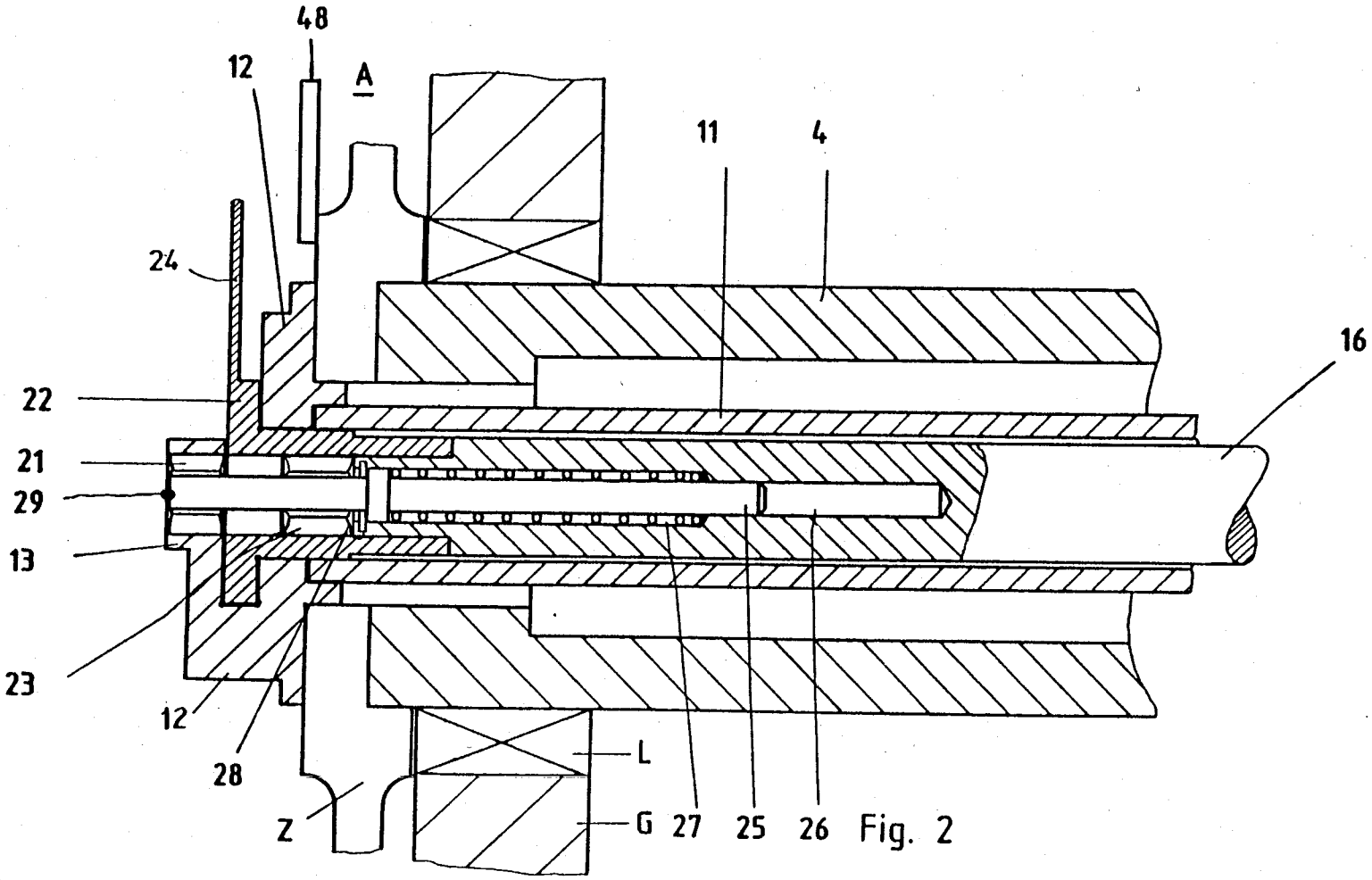
FIGS. 2 and 3 are enlarged partial sectional views of the means for clamping and adjusting the smoothing means of FIG. 1.

FIG. 2 is an enlarged partial section showing the arrangement of the adjusting means at end A of the storage cylinder 1. It corresponds in reality to the drive shaft of a press. The main shaft 4 is mounted by way of a bearing L in the machine frame G and is rigidly connected to a driving gear Z. The second hollow shaft 11 is secured in the bearing element 12 and by way thereof rotatably journalled within the gear Z. An internal hexagon 21 is provided, as a control element, in the prolongated end 13 of bearing element 12. Another internal hexagon 23 is disposed coaxially to the hexagon 21 as a control element for the shaft 16, in a bearing ring 22. The shaft 16 is rigidly connected to the bearing ring 22 and is journalled thereby in the shaft 11. The bearing ring 22 also has as an extension a pointer 24 to indicate the angular position of the shaft 16 with respect to a scale disc 48. For greater ease of reading, the scale on the disc 48 is spread a number of times, thus increasing the accuracy of adjustment. A sprung ejector pin 25 is provided as a safety feature in the shaft 16. The pin 25 is received in a bore 26 and is pressed by a spring 27 against a securing ring 28. In this position the complementarily shaped operative end 29 extends into the inner hexagon 21 and on to the surface of the prolongation 13, thus ensuring that an adjusting key cannot be left accidentally in the control elements 21,23.

Figure 3:
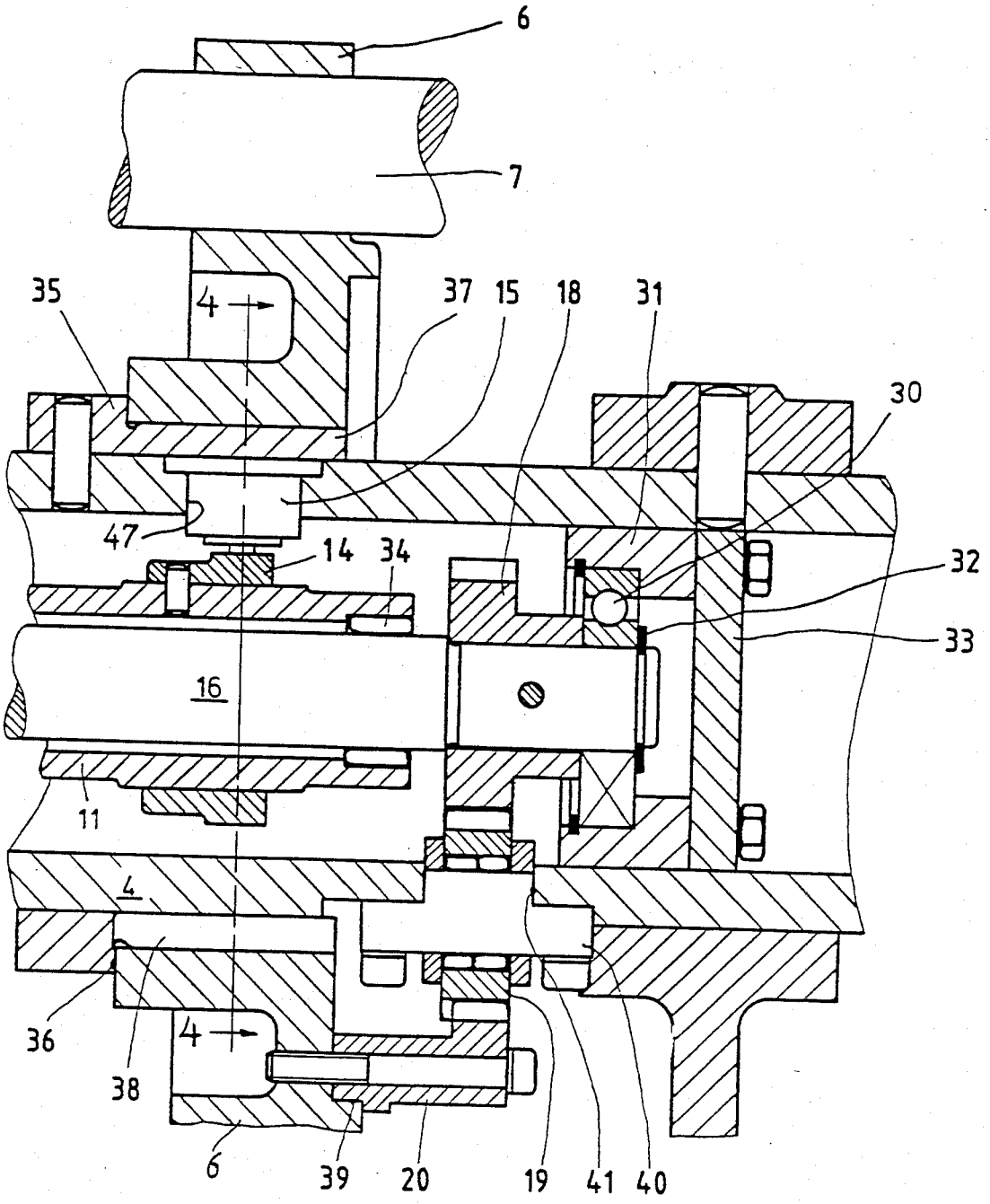

FIG. 3 is an enlarged partial section showing the mounting of the adjusting means inside the storage cylinder 1. The shaft 16 is mounted within the main shaft 4 by way of ball bearings 30 and a bearing ring 31. The ball bearing 30 is secured on the end of shaft 16 between the gearwheel 18 and a securing ring 32 and the gearwheel 18 is pinned to the shaft end. A sealing disc or plate 33 protects the ball bearing 18. The second hollow shaft 11 is mounted on the shaft 16 by way of a needle bearing cage 34. A clamping cam 14 is pinned to the shaft 11 and engages a clamping element 15 disposed in an opening 47 in the wall of the main shaft 4. The clamping element 15 bears by way of an outer operative surface 46 on an expanding sleeve 35 pinned to the main shaft 4. The sleeve 35 can be subdivided into a collar portion 36 and an expanding finger ring portion 37. The finger ring portion 37 is formed with expansion slots 38. A carrying element 6 which carries the shaft 7 is rotatably disposed on the ring 37. The toothed annular gear segment 20 is secured to a collar 39 of the conveying element 6. The intermediate planetary gear 19 is disposed on a bearing pin 40 between the segment 20 and the sun gear 18. The planetary gearwheel 19 is disposed in an aperture 41 in the wall of the main shaft 4 to whose outside the bearing pin 40 is suitably secured.

Figure 4:
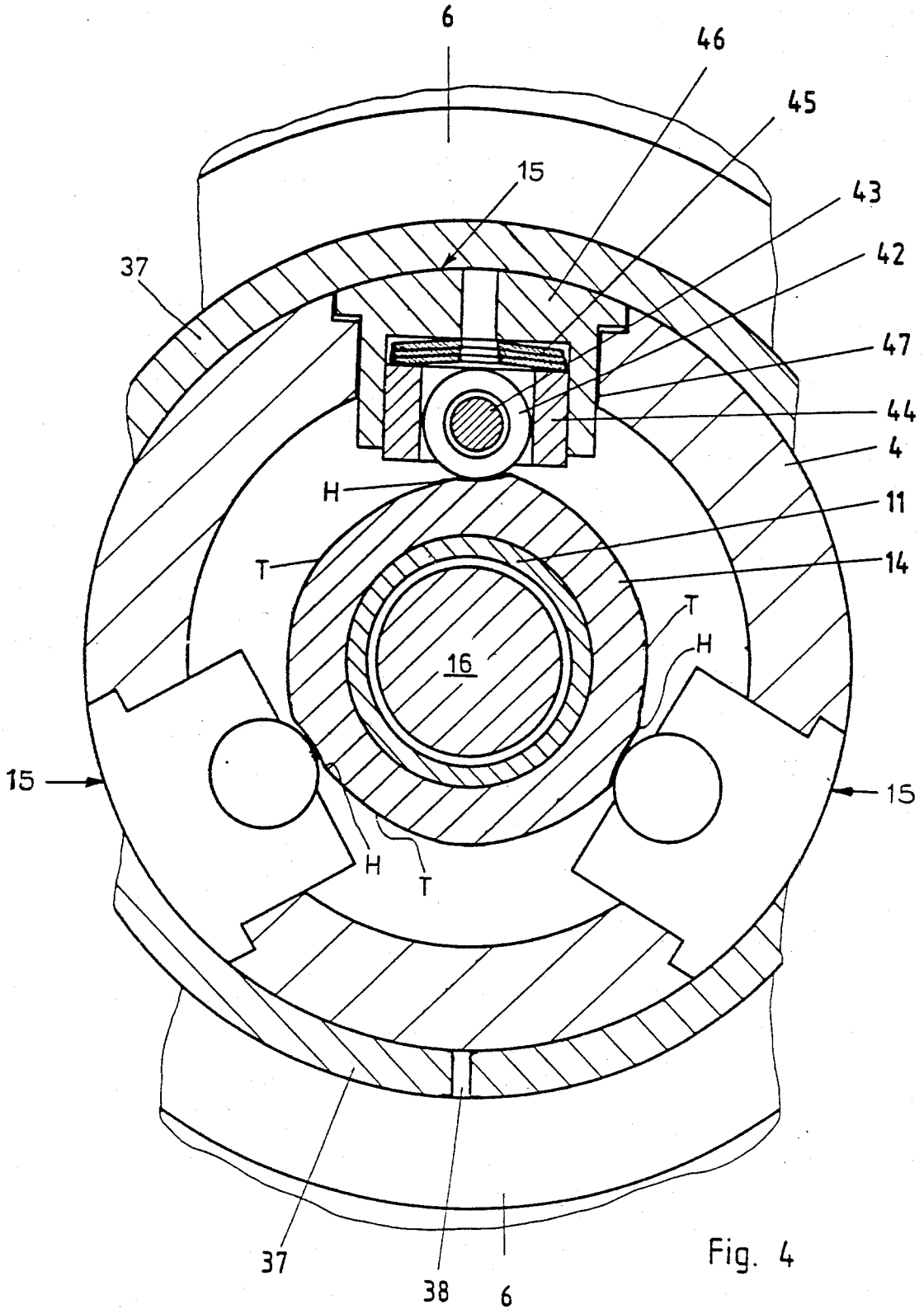
FIG. 4 is an enlarged partial cross section as seen substantially along line 4—4 in FIG. 3.

The construction of the clamping elements 15 is shown is greater detail in FIG. 4. The clamping elements 15 include rollers 42 retained by pins 43 in a slide bearing element 44, a set 45 of cup springs and a mushroom-shaped intermediate or pressing element 46. The roller 42 is disposed together with the pin 43, element 44 and spring set 45 inside the cylindrical element 46. The complete system serves as a spacer between the clamping cam 14 and the expanding finger ring 37 and is movable radially in an opening 47 in the wall of the main shaft 4.

The spring set 45 imparts a preloading force such as always to maintain the roller 42 in the bearing engagement with the cam 14. When the cam 14 is rotated from its bottom position T into its top position H, the clamping elements 15 are pressed outwards by the rollers 42 and the intermediate elements 46 engage and expand the ring fingers 37 between the slots 38 to clamp the carrying elements 6 on the ring 35. If desired, the clamping cam 14 can be arranged to have a catch position in its raised position H so that the cam 14 can be turned only to a predetermined position. The excess pressing necessary for this is permissible because of the spring set 45. It will be understood that the clamping force can be adjusted by an appropriate choice of the characteristics of the spring set 45. Moreover, since the clamping forces of the various clamping elements 15 are operative one against another, the mounting bearing 17 of the hollow shaft 11 is not stressed.

The control of the complete system is extremely simple. By means of a hexagon key or other spanner device whose operative cross-section is adapted to the length of the inner hexagon control elements 21 and 23, the clamping of the smoothing means 5 is first released by introducing the key into the inner hexagon 21 in the prolongated end 13 to turn the hollow shaft 11. Thereafter, the key engages with the ejector pin 25 and inside the inner hexagon 23 in the shaft 16. The shaft 16 can then be rotated by means of the gear train 18–20 to adjust all the smoothing means 5 in the peripheral direction of the storage cylinder 1. Upon the completion of adjustment, the key is ejected by the pin 25. Upon re-registration with the inner hexagon 21 in the extension 13, the smoothing means 5 can be clamped fast again by rotation of the hollow shaft 11. Consequently, a single control element—i.e., the hexagon key—suffices to clamp and adjust the smoothing means 5 in a single operation. Furthermore, the hexagon key cannot accidentally be left in the shaft 4 since it is ejected by the pin 25, thus obviating the risk of accidents.

From the foregoing, it will be seen that the adjusting means for the smoothing means of the storage cylinder is very simple and compact. It can be preassembled outside the storage cylinder main shaft 4 and installed as a unit. Moreover, the clamping can be adjusted quite precisely and reliably.

We claim as our invention:

1. A clamping and adjusting device for the smoothing means on a storage cylinder of a sheet offset press adapted for selective first printing or perfecting printing operation, wherein the smoothing means are mounted by way of carrying elements on a hollow main shaft of the storage cylinder and are adapted to be released, adjusted and, by way of clamping elements, clamped relative to the outer shell of the storage cylinder by central actuators, comprising, in combination, a unitary hollow drive shaft rotatably mounted within the hollow main shaft of the storage cylinder and having a first control element at one end and clamping cams on its periphery adjacent its other end, clamping elements including cam followers in bearing relationship between the clamping cams and the carrying elements; and an adjusting shaft rotatably mounted within the unitary hollow drive shaft and having a second control element at one end and having at its other end a gear wheel forming part of epicyclic gearing adapted to pivot the smoothing means on the storage cylinder.

2. A device according to claim 1, characterized in that the clamping elements include a generally mushroom-shaped pressing element having a top formed with a radius corresponding substantially to the radius of the hollow main shaft and having a bottom part formed with a center bore housing, a set of cup springs and a sliding bearing element, a bearing pin carrying a roller disposed in the bearing element so that the roller and the top of the pressing element act as opposite engagement surfaces for applying the force produced by the cup-spring set.

3. A device according to claim 1, characterized in that intermediate rings are disposed between the hollow main shaft and the carrying elements and the intermediate rings include expanding sleeves which have a collar at one end and are formed in their reduced part with axial fingers separated by slots.

4. A device according to claim 1, characterized in that the epicyclic gearing comprises a sun gear mounted on the end of the adjusting shaft for rotation inside the hollow main shaft, the intermediate gear is supported by a bearing pin disposed in a recess in the hollow main shaft and a toothed annular segment is secured to a carrying element of the smoothing means.

5. A device according to claim 1, characterized in that the adjusting shaft has its control end rotatably mounted by way of a bearing ring in the hollow drive shaft, a pointer is secured to the bearing ring, and a scale disc is so connected to the hollow main shaft as to be coaxial to the bearing ring, the scale having a spread scale length.

6. A device according to claim 1, characterized in that the control elements on the hollow drive shaft and adjusting shaft are internal hexagons one being connected to the bearing ring to rotate the adjusting shaft while the other is disposed in a connecting member as a cranked extension of the hollow drive shaft, said internal hexagon elements beings disposed coaxially and receiving an axially slidable securing key.

7. A device according to claim 6, characterized in that the adjusting shaft has a centrally disposed spring biased internal ejector pin, so that an adjusting tool identical for both internal hexagons can be introduced only against the force of the spring retaining the pin.

* * * * *